US005647334A

United States Patent [19]

Miller

[11] Patent Number: 5,647,334

[45] Date of Patent: Jul. 15, 1997

[54] FUEL VAPOR RECOVERY SYSTEM CONTROL VALVE

[75] Inventor: Terry L. Miller, Sterling, Ill.

[73] Assignee: Borg-Warner Automotive, Inc., Sterling Heights, Mich.

[21] Appl. No.: 555,090

[22] Filed: Nov. 8, 1995

[51] Int. Cl.[6] ..... F02M 37/04

[52] U.S. Cl. ..... 123/520; 137/574

[58] Field of Search ..... 123/520, 519, 123/518, 521, 198 D; 137/574, 576, 565

[56] References Cited

U.S. PATENT DOCUMENTS

| | | | |
|---|---|---|---|
| 5,056,493 | 10/1991 | Holzer | 123/520 |
| 5,056,494 | 10/1991 | Kayanuma | 123/519 |
| 5,099,880 | 3/1992 | Szlaga | 123/519 |
| 5,235,955 | 8/1993 | Osaki | 123/520 |
| 5,277,168 | 1/1994 | Kondo | 123/519 |
| 5,392,804 | 2/1995 | Kondo | 127/574 |
| 5,404,906 | 4/1995 | Aoshima | 123/519 |

*Primary Examiner*—Carl S. Miller
*Attorney, Agent, or Firm*—Reising, Ethington, Barnard & Perry; Greg Dziegielewski

[57] ABSTRACT

A fuel vapor recovery system has a control valve that is solenoid operated by a fuel filler pipe access door to control fluid communication between a fuel tank and a fuel vapor storage canister. The fuel tank includes a refueling valve that is open when the fuel tank is being refueled to provide a large unrestricted flow passage to the canister via the control valve. The refueling valve closes or restricts gas vapor flow at a predetermined fuel fill level in the tank to create a dome pressure, that is, a pressurized volume of gas in the space at the top of the tank above the fuel. This dome pressure causes the fuel level to rise in the filler pipe and automatically shut off the fuel filler nozzle in a well known manner. The fuel tank also has vent valves that provide restricted flow passages to the canister via the control valve for ordinary emissions of fuel vapors from the fuel tank. The control valve blocks the restricted flow path from the vent valves for refueling so that the dome pressure that automatically shuts off the fuel nozzle is controlled exclusively by the refueling valve. A preferred control valve also blocks the large unrestricted flow path from refueling valve when the access door is closed after refueling to protect against the canister being overloaded with fuel vapors.

12 Claims, 3 Drawing Sheets

FUEL VAPOR RECOVERY SYSTEM CONTROL VALVE

BACKGROUND OF THE INVENTION

This invention relates generally to fuel vapor recovery systems and more particularly to fuel vapor recovery systems that capture fuel vapors during a refueling operation.

One such type of fuel vapor recovery system has a fuel vapor canister that captures fuel vapors and a refueling valve and one or more vent valves that are located at or near the top of the fuel tank for handling the fuel vapors in the fuel tank.

During the refueling process, a large volume of air and fuel vapors is displaced in the fuel tank by fuel. Thus when the refueling process is initiated, the refueling valve is open to provide large unrestricted passage for the air and fuel vapors to flow from the fuel tank to the vapor recovery system quickly during the refueling process. The refueling valve also automatically closes at least part way to restrict flow when the fuel in the fuel tank reaches a predetermined fill level to create a dome pressure above the fuel in the fuel tank which causes fuel to rise in the fill pipe and automatically shut off the fuel fill nozzle in a well known manner. After the refueling process is completed the dome pressure dissipates via the refueling valve until it is completely closed or a vent valve which allows the fuel level in the fuel fill pipe to recede.

The vent valve or valves on the other hand provide restricted passages from the fuel tank to the vapor recovery system which allow a low volume of fuel vapors to escape while guarding against liquid fuel contamination of the fuel vapor canister. The vent valves also close automatically when the fuel level in the fuel tank rises to a predetermined level.

A potential problem occurs in a fuel vapor recovery system of this type when a vent valve is located above the refueling valve so that the vent valve is open when fuel in the fuel reaches the fill level during the refueling process. Such an open vent valve can effect the dome pressure and delay the automatic shut off of the fuel filler nozzle so that the fuel tank may possibly be over filled.

SUMMARY OF THE INVENTION

The object of this invention is to provide a control valve for a fuel vapor recovery system of the above noted type that assures proper automatic shut-off of the fuel fill nozzle.

A feature of the invention is that the control valve is actuated by a solenoid to facilitate remote control by an access door or other moveable member associated with a fuel filler pipe.

Another feature of the invention is that the control valve blocks off the vent valves before the refuelling process is initiated so that the refueling process is controlled by the refueling valve exclusively.

Still another feature of the invention is that control valve blocks off the vent valves before the refuelling process is initiated so that the dome pressure above the fuel in the fuel tank is controlled exclusively by the refueling valve during the refueling process.

Still another feature of the invention is that the control valve unblocks the vent valve or valves after the refueling process is completed so that the vent valve or valves operate in the normal way when the refueling process is completed.

Still another feature of the invention is that the control valve unblocks the vent valve or valves after the refueling process is completed so that the dome pressure above the fuel in the filled fuel tank can be dissipated via an elevated vent valve.

Still yet another feature of a preferred embodiment of the invention is that the control valve blocks the refueling valve after the refueling process is completed to protect against overloading the fuel vapor canister.

BRIEF DESCRIPTION OF THE DRAWINGS

The above and other objects, features and advantages of the invention will become more apparent from the following description taken in conjunction with the accompanying drawings wherein like references refer to like parts and wherein.

DESCRIPTION OF THE INVENTION

Figure 1:
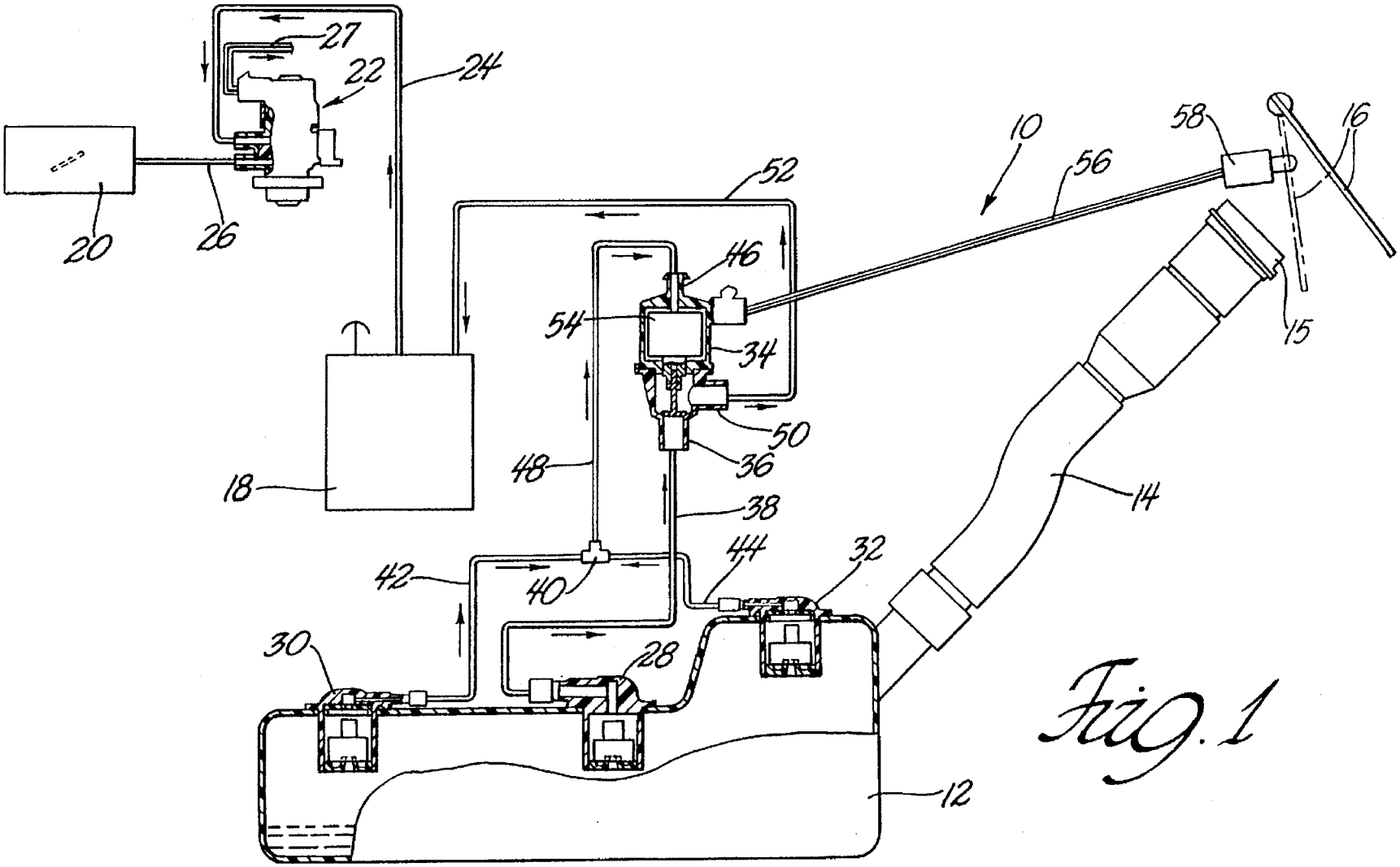
FIG. 1 is a schematic drawing of a fuel vapor recovery system equipped with a control valve in accordance with the invention.

Referring now to the drawing, FIG. 1 illustrates a fuel vapor recovery system 10 for an automotive fuel tank 12 that has a filler pipe 14 that is closed by a fuel cap 15 and that is accessed via an access door 16 of the automotive vehicle body (not shown).

The fuel recovery system 10 comprises a conventional vented fuel vapor canister 18 that contains activated charcoal, carbon, or other material that absorbs and desorbs fuel vapors. The canister 18 thus receives and stores fuel vapors from the fuel tank 12 and then delivers these stored fuel vapors to a fuel charge device 20, such as a throttle body, for combustion in the vehicle engine (not shown). The flow of the stored fuel vapors to the fuel charge device 20 is controlled by a purge valve 22 that is connected to the canister 18 by inlet conduit 24 and to the fuel charge device 20 by outlet conduit 26. Purge valve 22 is operated by a solenoid that is electronically controlled via electrical lead 27. Purge valves and their operation are well known to those skilled in the art so that a detailed description is not necessary.

By way of example U.S. Pat. No. 5,237,980 granted to William C. Gillier Aug. 24, 1993 discloses a solenoid purge valve and copending patent application Ser. No. 08/416,251 filed by Rosas, et al on Jun. 6, 1995 discloses an improved solenoid purge valve which are suitable.

The fuel tank 12 is equipped with a refueling valve 28 and two vent valves 30 and 32 for handling fuel vapors in the fuel tank 12 under various conditions. Refueling valve 28 and vent valve 30 are mounted in a top wall of the fuel tank 12 while vent valve 32 is mounted in an elevated top wall of the fuel tank 12 above the refueling valve 28.

The fuel vapor recovery system also comprises a control valve 34 that is incorporated in the system between the valves 28, 30 and 32 and the fuel vapor canister 18. More specifically the outlet of the refueling valve 28 is connected to a first inlet 36 of the control valve 34 via conduit 38. On the other hand the outlets of the vent valves 30 and 32 are connected to inlets of a tee 40 via conduits 42 and 44. The outlet of the tee 40 is then connected to a second inlet 46 of the control valve via conduit 48. The control valve 34 has an outlet 50 that is connected to the fuel vapor canister 18 by conduit 52. The control valve 34 is operated by a solenoid assembly 54 that is energized via an electrical lead 56 and an electrical push button switch 58 that is operated by the access door 16.

Figure 2:
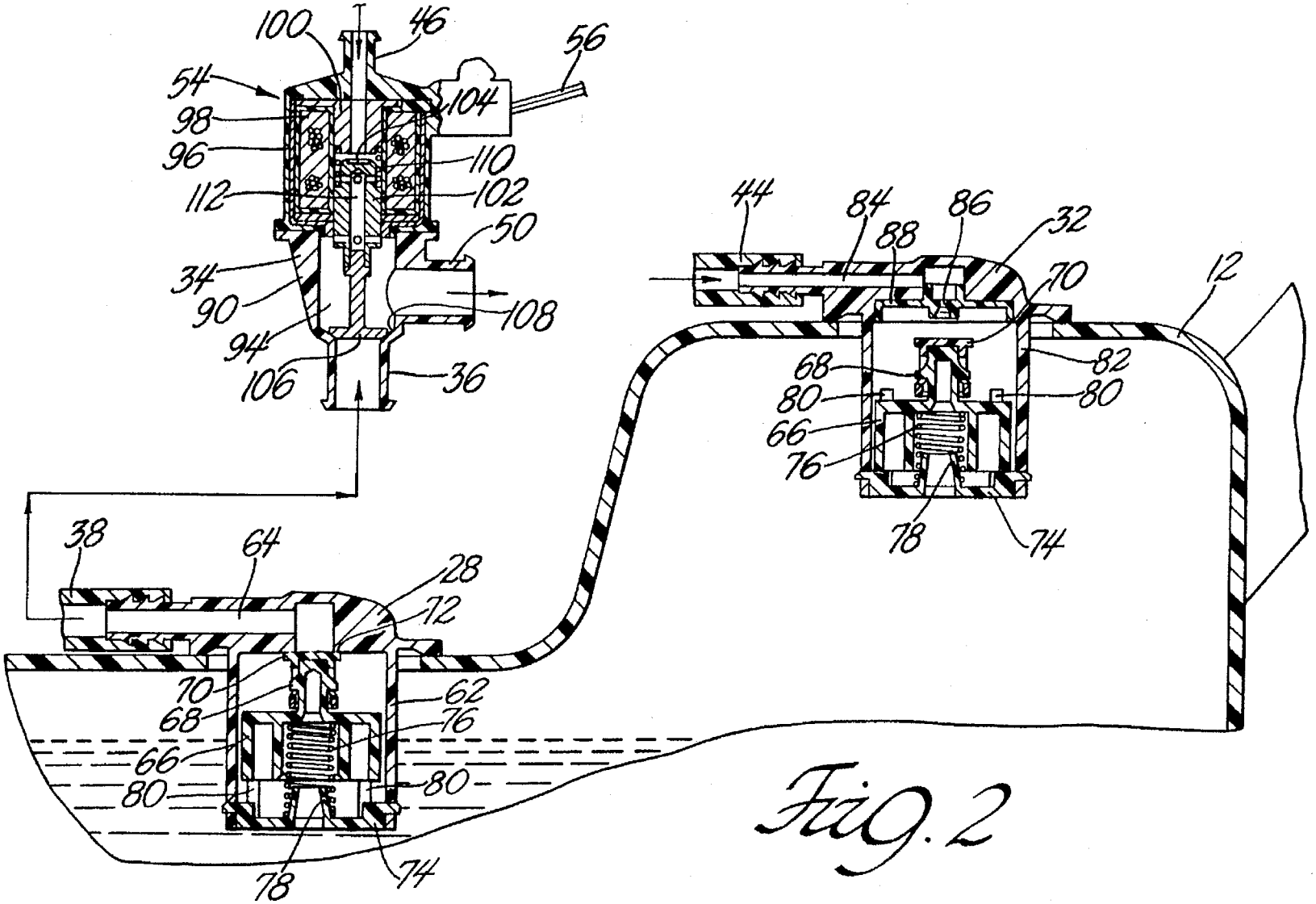
FIG. 2 is an enlargement of a portion of FIG. 1 showing details of the control valve, a refueling valve and an elevated vent valve shown in FIG. 1.

Referring now to FIG. 2, the refueling valve 28 comprises a valve body 62 that has a large outlet passage 64 that is connected to conduit 38. The valve body 62 contains a float 66 having a hollow upper mast 68 that carries a valve 70. The valve 70 is moved by the float 66 to engage valve seat 72 and close outlet passage 64. The refueling valve 28 further includes a spring seat 74 attached to the lower end of the valve body 62 and a spring 76. The spring 76 is disposed between the spring seat 74 and the float 66 to bias the float 66 upwardly. The spring seat 74 has a central collar 78 that provides an inlet for fuel vapors and liquid fuel. The valve body 72 also has slots 80 that provide additional inlets for the fuel vapors and liquid fuel.

In the absence of liquid fuel, the float 66 rests on the spring seat 74 and compresses the spring 76 due to its weight. The valve 70 is thus spaced from the valve seat 72 so that the refueling valve 28 is open. This allows air and fuel vapors in the fuel tank 12 to flow into the valve body 62 through collar 78 and slots 80, past or around the float 66 and then out through the large, unrestricted passage 64 into the fuel vapor recovery system via control valve 34.

When the fuel tank 12 is filled with fuel to the fill level as shown in FIG. 2, the buoyancy of float 66 and the bias of spring 76 counteract the weight of the float 66 and close the valve 70 against the valve seat 72 as shown in FIG. 2.

The refueling valve 28 also has a rollover feature that closes the refueling valve 28 when the fuel tank 12 tilts significantly such as in a partial or full vehicle rollover. When the refueling valve 28 is tipped significantly such as 90 degrees from the vertical position shown in FIG. 2, the spring 76 is effective to force the float 66 and valve 70 against the valve seat 72 and close the refueling valve 28. Moreover in the worst case of a vehicle rollover where the float 66 and valve 70 are inverted, the weight of the float 66 works in conjunction with the spring 76 so that the refueling valve 28 is closed with a high sealing force to prevent the escape of liquid fuel through the refueling valve.

The vent valves 30 and 32 are identical and very similar to the refueling valve 28 described above. The typical vent valve 32 shown in FIG. 2 comprises a valve body 82 that has a small outlet passage 84 in comparison to the outlet passage 64 of the refueling valve 28. The typical vent valve 32 also has a orifice 86 that restricts flow through the vent valve 32 when it is open. This orifice 86 is provided in an insert 88 that is pressed into the upper end of the valve body 82. The insert 88 serves as the valve seat and also includes a well on the downstream side of the orifice 86 for trapping and returning liquid fuel that might pass through the orifice. The vent valves 30 and 32 are otherwise the same as the refueling valve 28 and corresponding parts are identified with the same numerals. The vent valves 30 and 32 operate in the same way as the refueling valve 28. That is the vent valves 30 and 32 are open in the absence of liquid fuel as shown in FIG. 2 and closed when the liquid fuel in the fuel tank 12 rises to a level so that the buoyancy of the float 66 and the bias of the spring 76 is sufficient to counteract the weight of the float and close the valve 70 against the valve seat of the insert 88.

FIG. 2 illustrates the potential problem discussed above when the fuel vapor recovery system 10 has a vent valve 32 that is located above the refueling valve 28. In the situation illustrated in FIG. 2, the fuel tank 12 has been filled with fuel to the fill level closing the refueling valve 28. The refueling valve 28 is designed so that its closure produces a dome pressure, that is a pressure in the air and gas vapors trapped above the fuel in the empty upper portion of the fuel tank 12 that is sufficient to hold liquid fuel at a sufficiently high level in the filler pipe 14 so that the liquid fuel in the filler pipe 14 causes an automatic shut off of the fuel filler nozzle in a well known manner.

However as illustrated in FIG. 2, the elevated vent valve 32 above the refueling valve 28 is still open, so that it is possible for air and fuel vapors to escape out the open vent valve 32. If allowed, this escape would delay the required build up of dome pressure and automatic shut off of the fuel fill nozzle and could result in the fuel tank 12 being over filled. The control valve 34 of this invention solves this potential problem as explained below.

The control valve 34 comprises a valve body 90 and the solenoid 54 that is attached to an upper end of the valve body 98. The valve body 90 is molded in one piece of thermoplastic material and contains an internal chamber 94 that has an inlet at the upper end of the valve body 90 that abuts the lower end of the solenoid assembly 54. The valve body 90 includes two integral tubular extensions that communicate with the internal chamber 94 and provide the inlet 36 and the outlet 50 that are described above in connection with the fuel recovery system 10.

The solenoid assembly 54 comprises a thermoplastic housing 96 that has an integral extension at the upper end that provides the inlet 46 that is described above. The inlet 46 of the solenoid assembly 54 and the inlet 36 of the valve body 90 are coaxially aligned.

The housing 96 contains the solenoid parts including an electrical coil 98, and a stationery pole piece 100 at the upper end of the electrical coil 98. The pole piece 100 has a central passage that is coaxially aligned with and communicates with the inlet 46. The solenoid armature 102 is disposed in the lower part of the electrical coil 98 and protrudes into the chamber 94 when the solenoid assembly 92 is attached to the valve body 90 as shown in FIG. 2.

The solenoid armature 102 which is of two piece construction has an upper valve 104 and a lower valve 106. The lower valve 106 is biased against an internal shoulder or valve seat 108 in the valve body 90 by a coil spring 110 which is located between the pole piece 100 and the armature 102 and pushes the armature 102 away from the pole piece 100. In this position of the armature 102, the lower valve 106 closes off the inlet 36 as shown in FIG. 2. The armature 102 includes a flow through passage 112 comprising an internal axial passage and cross passages at the upper and lower ends of the axial passage. The flow through passage 112 establishes communication between the lower hollow end portion of the electrical coil 98 and the chamber 94 of the valve body 90 so that the inlet 46 communicates with the outlet 50 when the armature 102 is extended as shown in FIG. 2. When the armature 102 is retracted into the electrical coil 98 against the bias of the coil spring 110 by energizing the electrical coil 96. The lower valve 106 is unseated to open inlet 36 and the upper valve 104 closes off the passage through the pole piece 100.

The fuel recovery system 10 operates as follows. The access door 16 is opened to refuel the fuel tank 12. This closes the push button switch 58 which energizes the electrical coil 98 of the solenoid assembly 94. Energization of the electrical coil 98 retracts the armature 102 into the electrical coil 98 from a venting position shown in FIG. 2 to a refueling position where the upper valve seat 104 seals against the lower end of the pole piece 100 and closes off flow from the inlet 46 via the pole piece 100. This blocks off the vent valves 30 and 32. Retraction of the armature 102 also lifts the lower valve seat 106 away from the internal shoulder 108 so that the inlet 36 communicates with the outlet 50. This unblocks the refueling valve 28.

The refueling valve 28 is normally open for the refueling process due to a low fuel level in the fuel tank 14 so that the opening of the fuel access door 16 normally establishes a large unrestricted flow path from the fuel tank 12 to the vented vapor canister 18 via the open refueling valve 28 and the control valve 34 before the refueling process is initiated. This large unrestricted flow path provides a pressure relief for any vapor pressure in the fuel tank before the refueling process is initiated and an escape path for the air and fuel vapors in the fuel tank as the fuel tank is filled with fuel during the refueling process itself.

After the access door 16 is opened so as to condition the vapor recovery system for the refueling operation, the fuel cap 15 is removed from the fuel filler pipe 14 and the fuel nozzle (not shown) is inserted into the open end of the fuel filler pipe 14 for the refueling operation. Government regulations require that the fuel nozzle shut off automatically and the operation of such government mandated fuel nozzles are well known.

During the refueling process the fuel level in the fuel tank 14 rises until the fuel reaches a predetermined fill level as shown in FIG. 2. As the fuel nears the fill level, the float 66 of the refueling valve rises and restricts the outlet passage 64 causing a build up of dome pressure, that is the pressure of the air and fuel vapors that are trapped in the top of the fuel tank 12 above the fuel. This dome pressure in turn causes the fuel that is delivered by the fuel fill nozzle to rise up in the filler pipe 14 above the level of the fuel in the fuel tank until the fuel level in the fuel filler pipe 14 is high enough to shut off the fuel fill nozzle automatically.

During this refueling process, the elevated vent valve 32 is still open. However the control valve 34 blocks off the inlet 46 from the vent valves 30 and 32 so that the dome pressure and automatic shut off of the fuel filler nozzle is controlled by the refueling valve 28 exclusively. This avoids any possibility of delaying the automatic shut off of the fuel fill nozzle and over filling the fuel tank 12.

After the refueling process is completed, the fuel nozzle is withdrawn, the fuel cap 15 is attached to close the fuel filler pipe 14 and the access door 16 is closed. This opens the push button switch 58 which deenergizes the solenoid coil 98 and extends the armature 102 by the action of coil spring 110. The downward movement of the armature 102 opens the passage through the pole piece 100 and unblocks the vent valves 30 and 32 for operation in the fuel vapor recovery system 10. The downward movement of the armature 102 also seats the lower valve 106 against the shoulder 108 under the bias of coil spring 110 so that the refueling valve 28 is blocked off. This assures that fuel vapors do not flow from the fuel tank 12 to the canister 18 via the large unrestricted passage of the refueling valve 28 thus guarding against the canister being overloaded with fuel vapors due to operating conditions of the vehicle.

Figure 3:
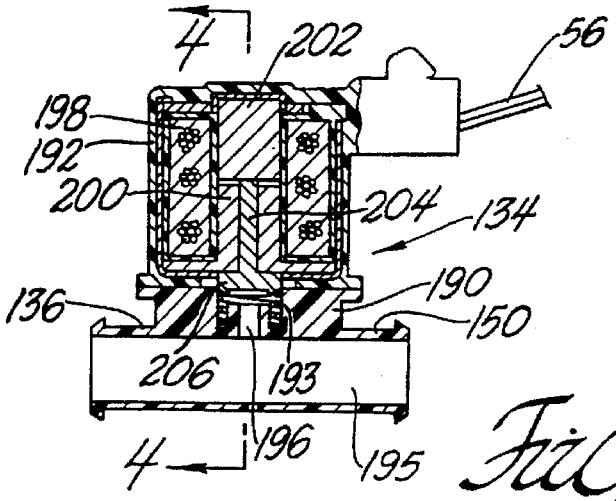
FIG. 3 is a sectional view of an alternate control valve for the fuel vapor recovery system shown in FIGS. 1 and 2.
Figure 4:
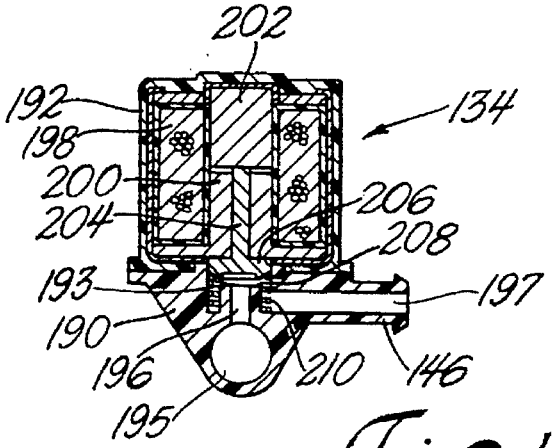
FIG. 4 is a section taken substantially along the line 4—4 of FIG. 3 looking in the direction of the arrows.

Referring now to FIGS. 3 and 4, an alternate control valve 134 is disclosed. The control valve 134 comprises a valve body 190 and a solenoid assembly 192 that is attached to an upper end of the valve body 198. The valve body 190 is molded in one piece of thermoplastic material in a low profile configuration that is triangular in cross section as best shown in FIG. 4. The valve body 190 contains an internal chamber 193 that has an opening at the upper or base end of the triangularly shaped valve body 190 that abuts the lower end of the solenoid assembly 192. The valve body 190 includes a cross passage 195 that extends through the valve body 190 and two integral tubular extensions at the lower or apex end of the valve body. The two tubular extensions are coaxially aligned with each other and communicate with the internal chamber 193 via an internal passage 196 that is coaxially aligned with the solenoid assembly 192. The two coaxially aligned tubular extensions provide an inlet 136 and an outlet 150 that are in constant communication with each other. When the control valve 134 is incorporated in the fuel vapor recovery system 10 that is illustrated in FIGS. 1 and 2, the inlet 136 is connected to the refueling valve 28 via the conduit 38 and the outlet 150 is connected to the fuel vapor canister 18 via the conduit 52 so that the refueling valve 28 is always in communication with the fuel vapor canister 18.

The valve body 190 includes a second cross passage 197 that communicates directly with the internal chamber 193. The passage 197 extends cross wise of the passage 195 and generally parallel to the base of the triangularly shaped valve body 190. The outer end of the cross passage 197 is located in a third tubular extension of the valve body 190 that provides a second inlet 146. The inlet 146 is connected to the vent valves 30 and 32 via conduits 42, 44, tee 40 and conduit 48 when the control valve 134 in incorporated into the fuel vapor recovery system 10.

The solenoid assembly 192 comprises a thermoplastic housing that contains the solenoid parts including an electrical coil 198, and a stationery pole piece 200 at the lower end of the electrical coil 198. The pole piece 200 has a central passage that is coaxially aligned with the passage 196 of the valve body 190 that communicates with the cross passage 195. A solenoid armature 202 is disposed in the upper part of the electrical coil 198 for movement between an extended position shown in FIGS. 3 and 4 and a retracted position (not shown) The armature 202 engages the stem of a T-shaped valve member 204 that is slideably disposed in the passage of the pole piece 200. The valve member 204 has a head 206 below the pole piece 200 that protrudes into the chamber 193 when the solenoid assembly 192 is attached to the valve body 190 as shown in FIGS. 3 and 4.

The head 206 of the valve member 204 is biased against the pole piece 200 and away from an internal valve seat 208 in the valve body 190 by a coil spring 210 which is located between the head 206 and the bottom of the chamber 193. This also pushes the armature 202 to an extended position against a raised stop in the top of the solenoid housing as shown in FIGS. 3 and 4. This extended position of the armature 202 establishes communication between the cross passage 197 and the cross passage 195 via the internal chamber 193 and passage 196 so that the inlet 146 communicates with the outlet 150 when the armature 102 is extended as shown in FIGS. 3 and 4.

When the armature 202 is retracted into the electrical coil 98 against the bias of the coil spring 210 by energizing the electrical coil 196, the head 206 of the valve member 204 seats against the valve seat 208 and closes off passage 196. This blocks the inlet 146.

When the control valve 134 is incorporated in the fuel recovery system 10 in place of the control valve 34, the fuel recovery system 10 operates as follows. The access door 16 is opened to refuel the fuel tank 12. This closes the push button switch 58 which energizes the electrical coil 198 of the solenoid assembly 192. Energization of the electrical coil 198 retracts the armature 202 into the electrical coil 198 from a venting position shown in FIGS. 3 and 4 to a refueling position where the head 206 seals against the valve seat 208 and closes off flow from the inlet 146.

After the access door 16 is opened so as to condition the vapor recovery system for the refueling operation, the fuel cap 15 is removed from the fuel filler pipe 14 and the fuel nozzle (not shown) is inserted into the open end of the fuel filler pipe 14 for the refueling operation. Government regulations require that the fuel nozzle shut off automatically and the operation of such government mandated fuel nozzles are well known.

During the refueling process the fuel level in the fuel tank 14 rises until the fuel reaches a predetermined fill level as shown in FIG. 2. As the fuel nears the fill level, the float 66 of the refueling valve rises and restricts the outlet passage 64 causing a build up of dome pressure, that is the pressure of the air and fuel vapors that are trapped in the top of the fuel tank 12 above the fuel. This dome pressure in turn causes the fuel that is delivered by the fuel nozzle to rise up in the filler pipe 14 above the level of the fuel in the fuel tank until the fuel level in the fuel filler pipe 14 is high enough to shut off the fuel nozzle automatically.

During this refueling process, the elevated vent valve 32 is still open. However the control valve 134 blocks off the inlet 146 from the vent valves 30 and 32 so that the dome pressure and automatic shut off of the fuel filler nozzle is controlled by the refueling valve 28 exclusively.

After the refueling process is completed, the fuel nozzle is withdrawn, the fuel cap 15 is attached to close the fuel filler pipe 14 and the access door 16 is closed. This opens the push button switch 58 which deenergizes the solenoid coil 198 and extends the armature 202 by the action of coil spring 210. The upward movement of the armature 202 opens the passage 196 and unblocks the vent valves 30 and 32 so that the vent valves 30 and 32 operate in the fuel vapor recovery system 10 in a normal manner.

Figure 5:
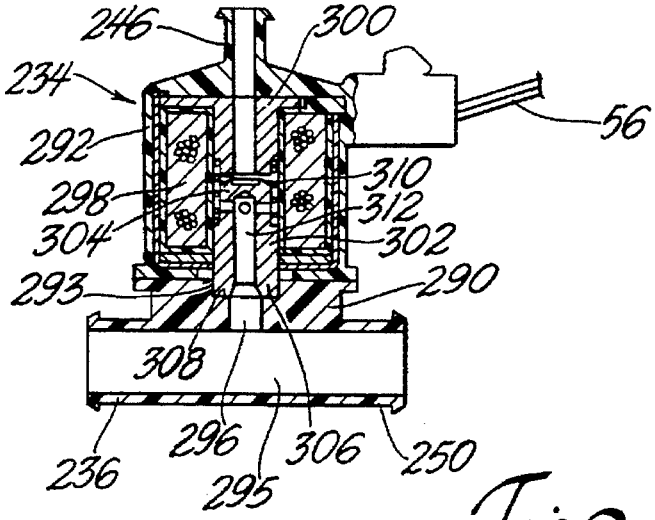
FIG. 5 is a sectional view of another alternate control valve for the fuel vapor recovery system shown in FIGS. 1 and 2.

Referring now to FIG. 5, another alternate control valve 234 is disclosed.

The control valve 234 comprises a valve body 290 and a solenoid assembly 292 that is attached to an upper end of the valve body 290. The valve body 290 is molded in one piece of thermoplastic material in a low profile configuration that is triangular in cross section like the valve body 190 shown in FIG. 4. The valve body 290 contains an internal chamber 293 that has an opening at the upper or base end of the triangularly shaped valve body 290 that abuts the lower end of the solenoid assembly 292. The valve body 290 includes a cross passage 295 that extends through the valve body 290 and two integral tubular extensions at the lower or apex end of the valve body. The two tubular extensions are coaxially aligned with each other and communicate with the internal chamber 293 via an internal passage 296 that is coaxially aligned with the solenoid assembly 292. The two coaxially aligned tubular extensions provide an inlet 236 and an outlet 250 that are in constant communication with each other. When the control valve 234 is incorporated in the fuel vapor recovery system 10 that is illustrated in FIGS. 1 and 2, the inlet 236 is connected to the refueling valve 28 via the conduit 38 and the outlet 250 is connected to the fuel vapor canister 18 via the conduit 52 so that the refueling valve 28 is always in communication with the fuel vapor canister 18.

The solenoid assembly 292 comprises a thermoplastic housing that has an integral extension at the upper end that provides a second inlet 246 that is connected to the vent valves 30 and 32 via the conduits 42, 44, tee 40 and conduit 48 when the control valve 234 is incorporated in the fuel vapor recovery system shown in FIGS. 1 and 2 in place of the control valve 34.

The housing of the solenoid assembly 292 contains the solenoid parts including an electrical coil 298, and a stationery pole piece 300 at the upper end of the electrical coil 298. The pole piece 300 has a central passage that is in alignment with and communicates with the inlet 246. The solenoid armature 302 is disposed in the lower part of the electrical coil 298 and protrudes into the chamber 293 when the solenoid assembly 292 is attached to the valve body 290 as shown in FIG. 5.

The solenoid armature 302 has an upper valve 304 and a lower end 306 that is biased against an internal shoulder 308 in the valve body 290 by a coil spring 310 which is located between the pole piece 300 and the armature 302 and pushes the armature 302 away from the pole piece 300.

The armature 302 includes a flow through passage 312 comprising an axial passage coaxially aligned with the passage 296 of the valve body 290 and cross passages at the upper end of the axial passage. The flow through passage 312 establishes communication between the lower hollow end portion of the electrical coil 298 and the chamber 293 of the valve body 290 so that the inlet 246 communicates with the outlet 250 when the armature 302 is extended as shown in FIG. 5.

When the armature 302 is retracted into the electrical coil 298 against the bias of the coil spring 310 by energizing the electrical coil 296 via lead 56, the upper valve 304 closes off the passage through the pole piece 300 thus blocking off the inlet 246 and the vent valves 30 and 32.

When the control valve 234 in incorporated in the fuel recovery system 10 in place of the control valve 34, the fuel recovery system operates as follows. The access door 16 is opened to refuel the fuel tank 12. This closes the push button switch 58 which energizes the electrical coil 298 of the solenoid assembly 292. Energization of the electrical coil 298 retracts the armature 302 into the electrical coil 298 from a venting position shown in FIG. 5 to a refueling position where the upper valve seat 304 seals against the lower end of the pole piece 300 and closes off flow to the chamber 293 from the inlet 246 via the pole piece 300.

After the access door 16 is opened so as to condition the vapor recovery system for the refueling operation, the fuel cap 15 is removed from the fuel filler pipe 14 and the fuel nozzle (not shown) is inserted into the open end of the fuel filler pipe 14 for the refueling operation. Government regulations require that the fuel nozzle shut off automatically and the operation of such government mandated fuel nozzles are well known.

During the refueling process the fuel level in the fuel tank 14 rises until the fuel reaches a predetermined fill level as shown in FIG. 2. As the fuel nears the fill level, the float 66 of the refueling valve rises and restricts the outlet passage 64 causing a build up of dome pressure, that is the pressure of the air and fuel vapors that are trapped in the top of the fuel tank 12 above the fuel. This dome pressure in turn causes the fuel that is delivered by the fuel nozzle to rise up in the filler pipe 14 above the level of the fuel in the fuel tank until the fuel level in the fuel filler pipe 14 is high enough to shut off the fuel nozzle automatically.

During this refueling process, the elevated vent valve 32 is still open. However the control valve 234 blocks off the inlet 246 from the vent valves 30 and 32 so that the dome pressure and automatic shut off of the fuel filler nozzle is controlled by the refueling valve 28 exclusively.

After the refueling process is completed, the fuel nozzle is withdrawn, the fuel cap 15 is attached to close the fuel filler pipe 14 and the access door 16 is closed. This opens the push button switch 58 which deenergizes the solenoid coil 298 and extends the armature 302 by the action of coil spring 310. The downward movement of the armature 302 opens the passage through the pole piece 300 and unblocks the vent valves 30 and 32 so that the vent valves operate in the fuel vapor recovery system 10 in a normal manner.

While the invention has been described in connection with an access door 16, the solenoid operated control valves 34, 134 or 234 could be operated by another moveable member associated with a fuel filler pipe, such as an auxiliary or second cap for the fuel filler pipe. In other words, the invention has been described in an illustrative manner, and it is to be understood that the terminology which has been used is intended to be in the nature of words of description rather than of limitation.

Obviously, many modifications and variations of the present invention in light of the above teachings may be made. It is, therefore, to be understood that, within the scope of the appended claims, the invention may be practiced otherwise than as specifically described.

The embodiments of the invention in which an exclusive property or privilege is claimed are defined as follows:

1. A solenoid operated control valve for a vapor recovery system for an automotive fuel tank having a refueling valve and a vent valve that is located above the refueling valve, the control valve comprising a valve body having a chamber, a first inlet for connecting the chamber to the refueling valve, a second inlet for connecting the chamber to the vent valve, and an outlet for connecting the chamber to a vapor storage canister, the control valve further comprising a valve that is moved by an armature of the solenoid to block the second inlet for refueling the fuel tank so that the flow out of the fuel tank is controlled exclusively by the refueling valve during the refueling process, the control valve further comprising a second valve that is moved by the armature of the solenoid to block the first inlet after the refueling process is completed, and the first and second valves being at opposite ends of the armature.

2. A solenoid operated control valve for a vapor recovery system for an automotive fuel tank having a refueling valve and a vent valve this is located above the refueling valve, the control valve comprising a valve body having a chamber, a solenoid attached to the valve body at one end of the chamber, the valve body having a first inlet at an opposite end of the chamber for connecting the chamber to the refueling valve, the control valve having a second inlet coaxially aligned with the first inlet and extending through the solenoid for connecting the chamber to the vent valve, and the valve body having a transverse outlet for connecting the chamber to a vapor storage canister, the control valve further comprising a valve that is attached to an armature of the solenoid for movement between a refueling position and a venting position, the valve blocking the second inlet in the refueling position so that the flow out of the fuel tank is controlled exclusively by the refueling valve when the fuel tank is being refueled, and the valve blocking the first inlet in the vent position so that flow out of the fuel tank via the refueling valve is blocked when the fuel tank is vented via the vent valve.

3. The control valve as defined in claim 2 wherein the valve includes the armature and has one end for blocking the first inlet and an opposite end for blocking the second inlet.

4. The control valve as defined in claim 3 wherein the armature has passages for connecting the second inlet to the chamber.

5. The control valve as defined in claim 4 wherein the solenoid is activated responsive to the position of a moveable member that is associated with a filler pipe for the fuel tank.

6. The control valve as defined in claim 5 wherein the solenoid is activated responsive to the position of a moveable access door that is associated with a filler pipe for the fuel tank.

7. A solenoid operated control valve for a vapor recovery system for an automotive fuel tank having a refueling valve and a vent valve this is located above the refueling valve, the control valve comprising a valve body having a chamber, a solenoid attached to the valve body at one end of the chamber, a passage extending through the valve body and communicating with an opposite end of the chamber, the passage having a first inlet at one end for connecting the chamber to the refueling valve and an outlet at an opposite end for connecting the chamber to a vapor storage canister, the control valve having a second inlet for connecting the chamber to the vent valve, and the control valve further comprising a valve that is moved by an armature of the solenoid to block the second inlet for refueling the fuel tank so that the flow out of the fuel tank is controlled exclusively by the refueling valve during the refueling process.

8. The control valve as defined in claim 7 wherein the valve body is a low profile configuration of triangular cross section and the flow through passage is a cross passage located at the apex of the valve body and defined in part by two tubular extensions of the valve body.

9. The control valve as defined in claim 7 wherein the second inlet is transverse to the passage that extends through the valve body and the passage communicates with the chamber via an axial passage that is closed by the valve.

10. The control valve as defined in claim 7 wherein the second inlet extends through the solenoid and the valve includes the armature and has one end for blocking the second inlet and passages for connecting the second inlet to the chamber.

11. The control valve as defined in claim 7 wherein the solenoid is activated responsive to the position of a moveable member that is associated with a filler pipe for the fuel tank.

12. The control valve as defined in claim 7 wherein the solenoid is activated responsive to the position of a moveable access door that is associated with a filler pipe for the fuel tank.

* * * * *